United States Patent [19]

Deen et al.

[11] 3,987,562

[45] Oct. 26, 1976

[54] QUICK CONNECT SNOW PLOW IMPLEMENT

[75] Inventors: Darrel B. Deen, Elk Point, S. Dak.; James E. Hrdy, Sioux City; Michael W. Schnurr, Hospers, both of Iowa

[73] Assignee: American Equipment Corporation, Sioux City, Iowa

[22] Filed: June 2, 1975

[21] Appl. No.: 582,603

[52] U.S. Cl. ..... 37/42 R; 172/275; 214/145 A

[51] Int. Cl.[2] ..... E01H 5/08; A01B 51/00

[58] Field of Search ..... 37/41, 42 R, 42 VL, 37/50; 172/275, 276, 801–809, 272–274; 214/145 A; 280/186

[56] References Cited

UNITED STATES PATENTS

| | | | |
|---|---|---|---|
| 2,057,326 | 10/1936 | Coates | 37/42 R |
| 2,426,410 | 8/1947 | Owen | 37/42 R |
| 2,710,464 | 6/1955 | Husting | 37/42 R |
| 3,150,884 | 9/1964 | Drott | 37/42 R X |
| 3,214,138 | 10/1965 | Jocher et al. | 37/42 R X |
| 3,343,850 | 9/1967 | Stauss et al. | 37/41 X |
| 3,388,929 | 6/1968 | Miley | 37/42 R X |
| 3,410,008 | 11/1968 | Standfuss | 37/42 R |
| 3,746,368 | 7/1973 | Gledhill et al. | 37/42 R X |
| 3,815,687 | 6/1974 | Federspiel | 37/42 R X |
| 3,851,894 | 12/1974 | St. Pierre | 37/42 R X |

FOREIGN PATENTS OR APPLICATIONS

| | | | |
|---|---|---|---|
| 521,201 | 1/1956 | Canada | 172/275 |
| 1,272,636 | 9/1960 | France | 172/275 |
| 1,489,716 | 4/1965 | France | 172/275 |
| 1,164,323 | 11/1962 | Germany | 214/145 A |
| 1,255,376 | 6/1966 | Germany | 172/275 |

*Primary Examiner*—E. H. Eickholt
*Attorney, Agent, or Firm*—Lowe, Kokjer, Kircher, Wharton & Bowman

[57] ABSTRACT

A snow plow implement for quick connection to a vehicle. The moldboard of the implement is mounted for yieldable but limited pivotal movement on the forward end of a rigid push frame which includes a pair of rearwardly extending arms. Pivotal jaws and associated fork plates are mounted on the rearward end of each arm. A frame assembly mounted on the front end of the vehicle includes a pair of axially aligned hitch pins. As the vehicle is driven toward the implement, the hitch pins engagingly pivot the jaws to closed positions wherein they cooperate with the associated fork plates to firmly retain the hitch pins and thereby couple the implement to the vehicle. Spring loaded locking pins act automatically to lock the jaws in their closed positions. The coupled implement is raised and lowered about the pivot axis of the hitch pins by a power cylinder which is folded up within a protective arm member when not in use.

3 Claims, 6 Drawing Figures

QUICK CONNECT SNOW PLOW IMPLEMENT

BACKGROUND AND SUMMARY OF THE INVENTION

This invention relates generally to snow plows and particularly to snow plow implements that are removably coupled to vehicles.

Snow plow implements of this type include a hitch mechanism which couples the plow blade to the vehicle, usually a pick-up truck. The main disadvantage of existing equipment is that considerable time and effort is typically required in order to connect the implement to the truck and to disconnect it therefrom. Prior art equipment is further characterized by excessive complexity which leads to high manufacturing costs and substantial maintainance problems.

In addition, the moldboards of existing implements are susceptible to being damaged due to the manner in which they are mounted. The desirability of providing for the yielding of the moldboard when the blade strikes a stationary obstacle has been recognized. However, even the moldboards that are mounted for yieldable pivoting are permitted to pivot in a relatively unrestricted manner. Consequently, the moldboard frequently pivots to such an extent that it bangs against the pavement or against a portion of the push frame, causing damage that requires costly repair or replacement of the moldboard.

It is therefore an important object of the present invention to provide an improved snow plow implement which may be quickly and easily coupled to a vehicle and uncoupled therefrom.

Another object of the invention is to provide a snow plow implement that includes coupling means which connects more firmly to the vehicle than existing hitch mechanisms and which is prevented from inadvertently releasing.

An additional object of the invention is to provide a snow plow implement having a moldboard that is mounted for yieldable pivoting but is restricted in the extent of its pivotal movement so as not to be subjected to damage.

Yet another object of the invention is to provide a snow plow implement in which the power cylinder that raises the moldboard may be folded into a protected position when not in use and yet may be easily unfolded for operation.

A further object of the invention is to provide a snow plow implement that is constructed both ruggedly and economically.

Other objects of the invention together with the advantages which are pertinent thereto will appear during the course of the following description.

DETAILED DESCRIPTION OF THE INVENTION

In the accompanying drawings which form a part of the specification and are to be read in conjunction therewith, and in which like reference numerals are employed to indicate like parts in the various views.

Figure 1:
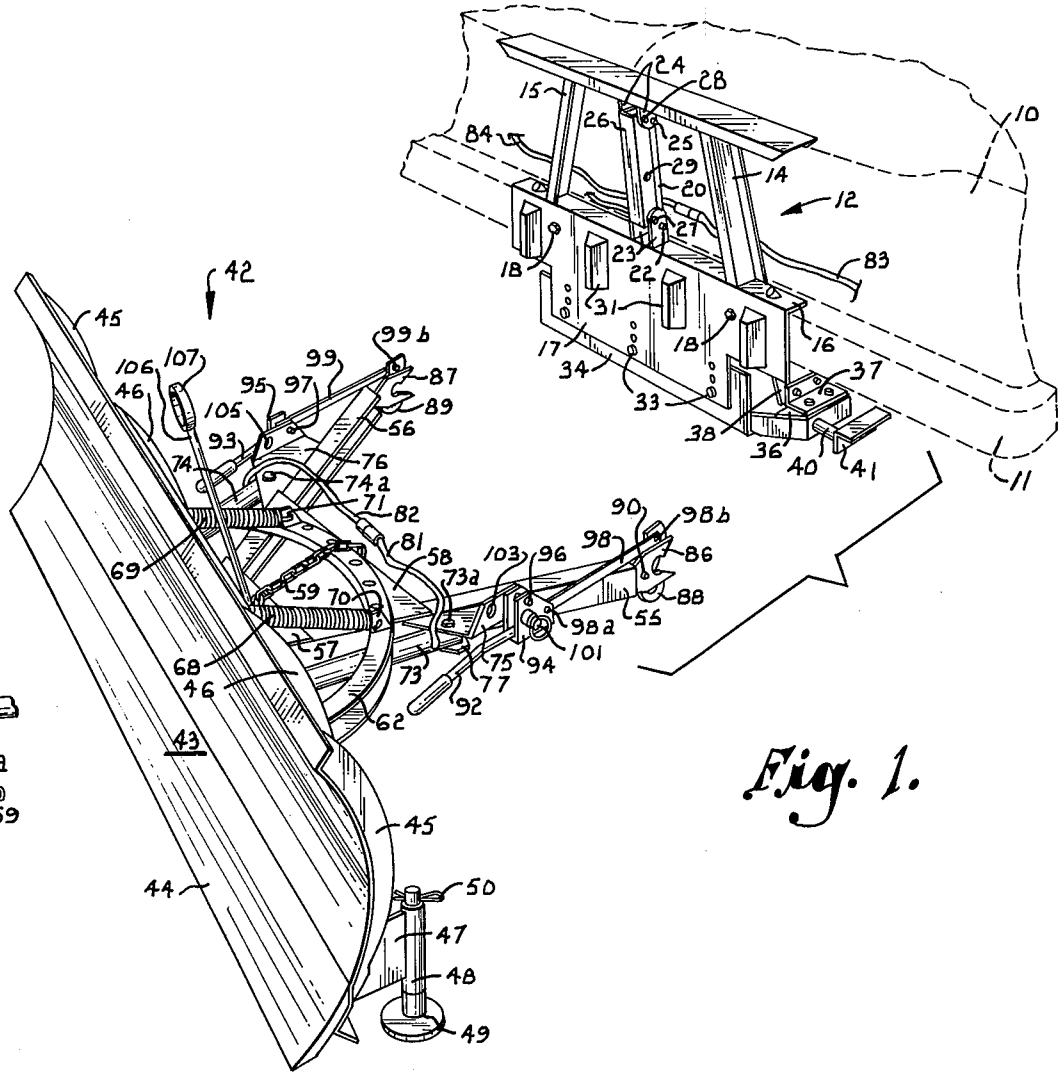
FIG. 1 is an exploded perspective view illustrating a snow plow implement constructed according to the present invention uncoupled from a vehicle having a frame assembly mounted on the front end thereof, with the vehicle being shown fragmentarily in broken lines.

Referring now to the drawings in detail and initially to FIG. 1, a conventional pick-up type truck is designated by reference numeral 10, and the front bumper thereof is designated by numeral 11. A frame assembly 12 is adapted to be mounted on the front end of the truck. A horizontal channel 13 located at the top of frame assembly 12, being supported on a pair of structural members 14 and 15 angling inwardly and upwardly from a horizontal flange 16 which is turned rearwardly at 90° from the top edge of a flat vertical plate 17. Plate 17 is securely bolted to bumper 11 by a pair of bolts 18, with a flanged rubber pad 19 (FIG. 6) interposed between the plate and bumper in order to protect the latter.

Figure 6:
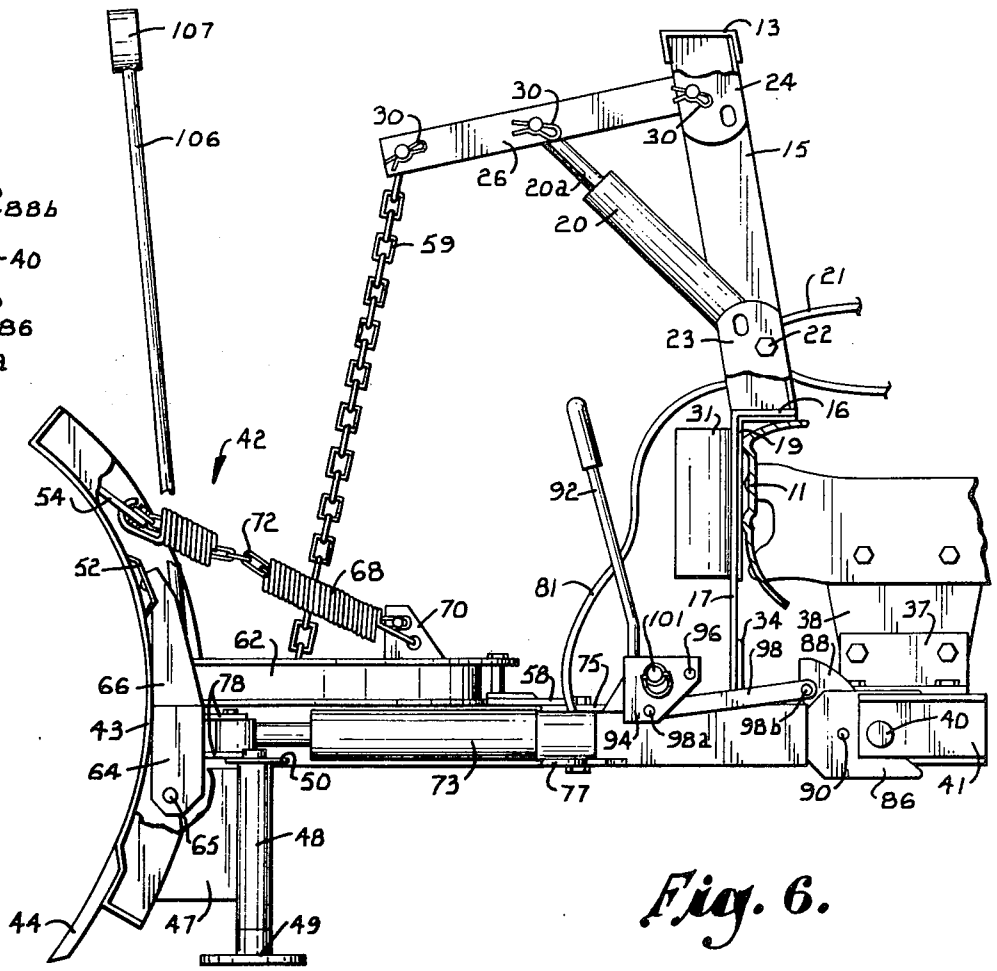
FIG. 6 is a side elevational view showing the snow plow implement coupled to the vehicle, with parts broken away to more clearly illustrate certain details.

With additional reference to FIG. 6, a hydraulic cylinder 20 is mounted on frame assembly 12 and is provided with a flexible fluid line 21 that connects to a hydraulic pump (not shown) carried by truck in order to supply the cylinder with hydraulic fluid. Switch controls (also not shown) for operating cylinder 20 in the usual manner are preferably mounted on the instrument panel within the cab of the truck.

The bottom end of cylinder 20 is pivotally connected by a pivot coupling 22 between a pair of ears 23 that extend upwardly from a central portion of flange 16. The piston rod **20*a* of cylinder 20, in its stored and inoperative position as illustrated in FIG. 1, is pinned between a second pair of ears 24 that extend downwardly from channel 13 at a location directly above ears 23. The piston rod of cylinder 20 is pinned between ears 24 by a pin 25. Pin 25 is removable to release the piston rod and permit cylinder 20 to pivot about coupling 22**, as shown in FIG. 6.

A channel shaped arm 26 is pinned in its stored and inoperative position (FIG. 1) between ears 23 and 24 at its opposite ends by respective pins 27 and 28. When in the stored position, arm 26 completely encloses cylinder 20. Pin 27 is removable to release the bottom end of arm 26 so that the arm is freely pivotal about the upper pin 28, as shown in FIG. 6. An intermediate portion of arm 26 is apertured at 29 for connection to the piston rod of cylinder 20 when the arm and cylinder are unfolded from their stored position. A plurality of cotter keys 30 (FIG. 6) are preferably provided to retain the various pins in place.

Referring again to FIG. 1, four horizontally spaced cushions 31 project outwardly from the forward surface of plate 17 and are located at the same elevation as bumper 11. Cushions 31 are preferably rubber or a similar substance to permit truck 10 to push other vehicles with the frame assembly mounted thereon.

The lower portion of plate 17 is provided with a plurality of bolt holes which are arranged in three vertical rows. Bolts 33 are placed through these holes to secure another plate 34 against the back surface of plate 17, with the arrangement of the bolt holes permitting plate 34 to be adjusted in its elevation relative to plate 17. The lower end of plate 34 is turned inwardly beneath bumper 11 and is spaced a considerable distance above the ground.

A bent arm 35 is welded to the right edge of plate 34 at the bottom thereof. Arm 35 includes an angled forward portion which extends outwardly and rearwardly from plate 34 and a straight rearward portion which is parallel to the axis of the truck. A horizontal plate 36 is welded to the top edge of arm 35 and has an angle member 37 bolted to its top side. The upstanding flange of angle member 37 is bolted to a vertical plate 38 which is in turn bolted to a sturdy portion of the under carriage of the truck, as best illustrated in FIG. 6. A cylindrical hitch pin 40 is welded to extend horizontally outwardly from the straight portion of arm 35. Finally, an angle 41 is welded to the end of pin 40 and is spaced outwardly of arm 35.

It is to be understood that the opposite side of frame assembly 12 includes structure corresponding to that described in the preceding paragraph, though not shown, which extends from the opposite side of plate 34 and which is substantially a mirror image of that just described. The hitch pin of this corresponding structure is axially aligned with hitch pin 40.

The snow plow implement is generally designated by reference numeral 42 and includes a curved moldboard 43 which is provided with rearwardly turned flanges at its top and bottom edges. The forward surface of moldboard 43 is recessed slightly at its bottom portion to receive a sharp blade 44 which is bolted to the moldboard for easy removability to permit replacement or sharpening of its scraping edge.

Four spaced, parallel ribs curve the back surface of moldboard 43 between the top and bottom flanges thereof. A pair of outer ribs 45 are located near the opposite ends of the moldboard, while a pair of intermediate ribs 46 are spaced on opposite sides of the center of the moldboard. A rigid plate 47 extends rearwardly from each outer rib 45, and a vertical sleeve 48 is welded to the back edge of each plate 47. Only one plate and sleeve are shown in the drawings; it will be understood that the construction of the plow is substantially symmetrical. A stand 49 is received in each sleeve 48 and is secured therein by a cotter pin 50. Each stand comprises an upright post which extends through a sleeve 48 and a circular pad which engages the ground to support the snow plow attachment in a position (FIG. 1) wherein it may be coupled to frame assembly 12.

Figure 2:
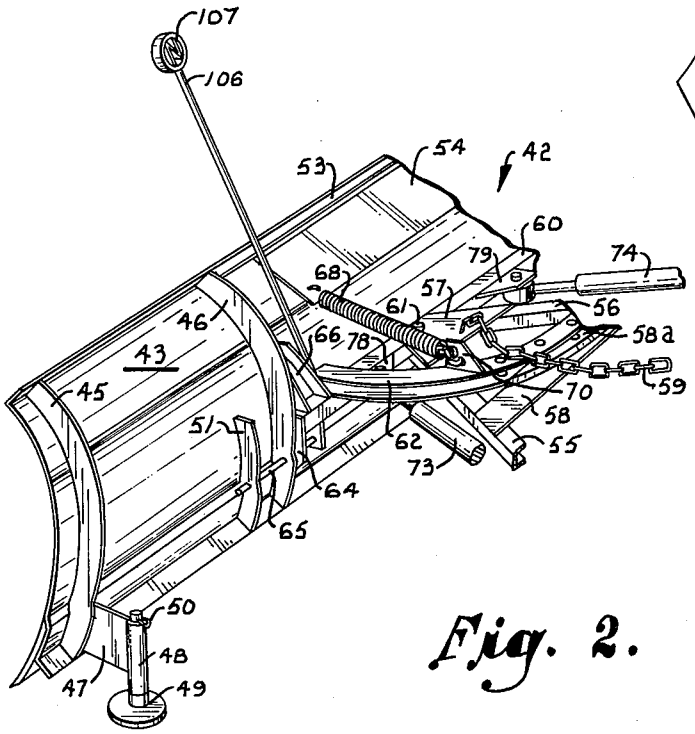
FIG. 2 is a fragmentary perspective view taken from the rear of the snow plow implement shown in FIG. 1.

A pair of shorter ribs 51 (only one of which is seen in FIG. 2) extend along the back surface of moldboard 43 at positions spaced to the outside of the intermediate ribs 46. A pair of pads 52 are mounted on the back surface of the moldboard at locations adjacent to the respective intermediate ribs 46. A reinforcing bar 5 extends between intermediate ribs 46 along the upper flange of moldboard 43. A rectangular plate 54 has a flange at its top edge which is connected to bar 53 to mount plate 54 in rearward and downward extension from the moldboard.

Moldboard 43 is carried on the forward end of a rigid A-shaped push frame which includes a pair of channel shaped structural arms 55 and 56. Arms 55 and 56 are connected to a triangular plate 57 at their forward ends and diverge rearwardly and outwardly therefrom. A brace 58 interconnects intermediate portions of arms 55 and 56. A chain 59 is secured at one end to plate 57 and has its other end free when the snow plow implement is not in use.

The triangular plate 57 is pivotally connected to a central portion of a bar 60 by a vertical pivot pin 61. A substantially semi-circular arcuate channel 62 has its opposite ends welded to the top of bar 60. The rearward portion of channel 62 rests on top of arms 55 and 56, and brace 58 is offset upwardly as at **58*a* to receive and provide a guide for the lower flange of the channel, as best illustrated in FIG. 2**.

A pair of ears 64 extends downwardly from each of the opposite ends of bar 60. As particularly shown in FIG. 2, each pair of ears 64 serves as a mount for a horizontal shaft 65 which is also inserted through aligned apertures in the adjacent intermediate rib 46 and its associated shorter rib 51. Moldboard 43 is thereby mounted for pivotal movement about the horizontal axis defined by the two axially aligned shafts 65. A pair of short arms 66 are mounted to extend upwardly from the opposite ends of bar 60. As best illustrated in FIG. 6, with moldboard 43 in its substantially upright operating position, the pads 52 earlier described are engaged by the top portions of arms 66, which are formed to conform to the shape of the pads.

A pair of tension springs 68 and 69 are provided to bias the moldboard toward its upright operating position. Springs 68 and 69 are hooked at one end in the respective ears 70 and 71 welded to the top of member 62 and at their opposite ends in apertures formed through plate 54. Springs 68 and 69 exert a substantial rearward force on the moldboard, although they will yield to permit the moldboard to pivot forwardly about shafts 65, as when blade 44 strikes a stationary object.

As shown in FIG. 6, each of the springs 68 and 69 contains a chain operable to limit the degree of pivotal movement permitted moldboard 43 and to prevent damage to same. Chains 72 are secured at one end to the respective ears 70 and 71 and at their opposite ends to plate 54. Each chain 72 is of sufficient length to permit forward pivoting of moldboard 43 to the point where the upper edge of the moldboard is just above ground level; further pivoting of the moldboard is prevented when the slack is taken up in the chains and they reach their full extension.

A pair of hydraulic cylinders 73 and 74 are provided to pivot the moldboard about the vertical axis defined at pin 61. As best seen in FIGS. 1 and 2, a pair of angle plates 75 and 76 having upstanding flanges are welded to intermediate portions of the receptive arms 55 and 56. The back end of cylinder 73 is pivotally pinned at **73*a* between a pair of parallel plate members 75, 77 which are secured to arm 55. Cylinder 74 is similarly pinned as at 74*a* between a plate 76 and an underlying plate (not shown) secured to the arm 56. The piston rods of cylinder 73 and 74 are pinned between respective pairs of lugs 78 and 79 which extend from bar 60** on opposite sides of its center.

Hydraulic lines 81 and 82 for cylinders 73 and 74 have mating male and female fittings that enable them to be connected together when the snow plow implement is not in use, as shown in FIG. 1. Additional hydraulic lines 83 and 84 which connect to a hydraulic pump on the truck are also provided with male and female fittings so that they can be connected together and secured against the front portion of the truck when not in use. During operation, lines 81 and 83 are adapted for connection to supply hydraulic fluid to cylinder 73, and lines 82 and 84 likewise may be connected to supply cylinder 74 with fluid. Suitable switch controls (not shown) are preferably mounted in the cab of truck 10 for operating cylinders 73 and 74 in the usual manner.

Figure 3:
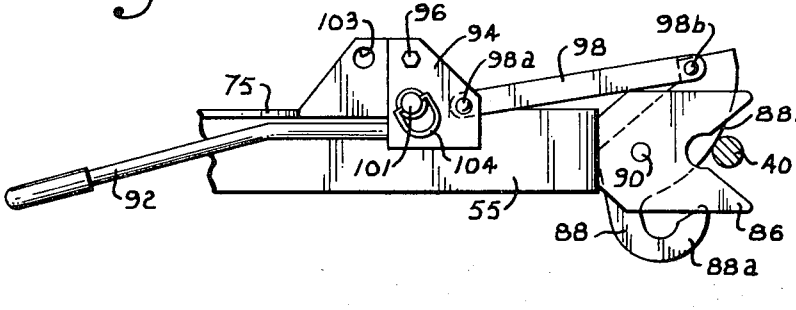
FIG. 3 is a fragmentary elevation view on an enlarged scale illustrating one of the jaw members of the snow plow implement in an open position prior to being engaged by one of the hitch pins of the vehicle mounted frame assembly.
Figure 4:
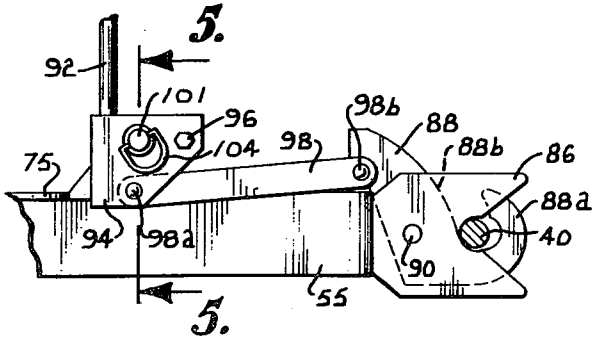
FIG. 4 is a fragmentary elevational view similar to FIG. 3, but with the jaw member shown in a closed position upon the hitch pin to couple the implement to the vehicle.

Turning now to a description of the hitch mechanism and referring also to FIGS. 3 and 4, each of the arms 55 and 56 of the push frame terminates at its rearward end with a fork plate 86, 87. Each fork plate includes rearwardly projecting tine like portions which are shaped to define a V-shaped notch, the base of which is of a semi-circular shape with a radius to permit interfitting of the hitch pins 40 which are mounted on the truck frame 12. Associated with each plate is a hooked shaped jaw 88, 89 terminating in a hook portion 88*a*, 89*a*, and also provided with a curved camming surface or edge 88*b*, 89*b* which overlaps and blocks the base of the semi-circular notch in the forked plate with the jaws in the open position illustrated in FIG. 3. Each jaw is pivotally mounted to its associated fork plate by a pivot pin 90 or 91.

The configuration of the camming surfaces 88*b* or 89*b* are important to the operation of the unit. Each is so shaped and located relative to the axis of the jaw pivot that the lateral pressure exerted by the hitch pin 40 during coupling will create a turning moment on the jaw about the jaw pivot which acts to pivot the jaw toward the closed position. Preferably the camming surface is so relieved near the hook end that when the jaw reaches the full closed position of FIG. 4, the camming surface either coincides with the base of the notch in the forked plate or is no longer in contact with the hitch pin. It will be further noted that the pivot pin (90 or 91) is at the same horizontal level as the base of the notch, and the center of the hook 88*b* (or 89*b*); any reverse loads tending to separate the vehicle from the plow will be in line with the pin and will not tend to open the jaw.

Manual operation of each jaw is effected through manipulation of a pivotal hand lever 92, 93 secured to a member 94 or 95, both of which function much like a bell crank; the members 94, 95 are pivoted respectively at 96, 97 to an upstanding flange on plate 75, 76 respectively. Each bell crank member is U-shaped in crosssection. Links 98, 99, are pivoted at one end as at 98*a*, 99*a* between the sides of members 94, 95 with the pivot axis offset from the pivot axis for the crank member. The other ends of the links are pivotally connected as at 98*b*, 99*b* with the end portions of the respective jaws 88 and 89.

Figure 5:
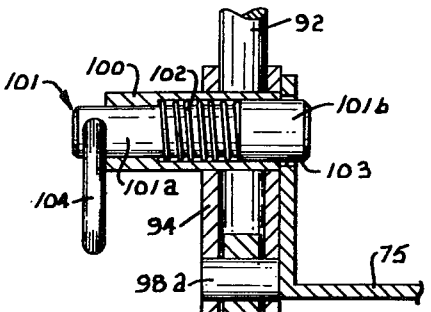
FIG. 5 is a cross-sectional view, on an enlarged scale, taken generally along line 5—5 of FIG. 4 in the direction of the arrows.

Referring now to FIG. 5, the spaced sides of the respective bell crank members 94, 95 are provided with aligned apertures that are similarly radially offset in each case from the pivot 96 or 97 for the bell crank members and also from the pivot connection of the respective links 98, 99. A cylindrical sleeve 100 is secured in these apertures and projects outwardly from each bell crank member. The bore of sleeve 100 is of stepped configuration to define an inner portion of greater diameter than the outer portion. A locking pin 101 is slidably received in the bore of sleeve 100. Pin 101 comprises a cylindrical shaft 101*a* that slidably fits within the smaller bore portion of the sleeve and an enlarged cylindrical end 101*b* that fits in the larger portion of the bore.

A compression spring 102 is coiled around shaft 101*a* with one end of the spring bearing against end 101*b* and the opposite end of the spring retained against a shoulder presented at the junction of the two bore portions of sleeve 100. Accordingly, spring 102 continuously urges pin 101 inwardly toward the upstanding flange of plate 75. An opening 103 is formed through the flange of plate 75 at a location to receive pin 101 and thus automatically locks bell crank member 94 against movement when member 94 is pivoted to the position shown in FIG. 4. The outer end of pin 101 projects beyond sleeve 100 and is apertured to receive a ring 104 which may be pulled outwardly to withdraw pin 101 from opening 103 and unlock member 94.

Bell crank 95 is also provided with a spring biased lock pin assembly (not shown) which is identical to that described for member 94. This lock pin fits into an opening 105 formed in the upstanding flange of plate 76 to automatically lock member 95 in place when its jaw is moved to closed position corresponding to that of FIG. 4.

Referring to FIG. 2 in particular, an elongate rod 106 extends upwardly from the left end of channel 62 and has a circular sight 107 on its top end. Sight 107 is located directly ahead of the driver of the truck at approximately just above head level to provide a guide as the snow plow implement is coupled to the truck. Sight 107 is also useful during operation of the snow plow because it indicates the angular orientation of the moldboard about the vertical pivot pin 61.

When uncoupled from the vehicle, the snow plow implement is stored in the position shown in FIG. 1. Also, cylinder 20 and arm 26 are folded up such that the cylinder is completely enclosed within the arm, as shown in FIG. 1.

The coupling of the implement is accomplished by driving the truck theretoward to position the respective hitch pins 40 in the notches of fork plates 86, 87, with sight 107 providing guidance to the driver. As pins 40 enter the notches they cam against the curved forward edges of jaws 88 and 89 and thereby pivot the jaws about their pivot connection to fork plates 86 and 87. When pins 40 reach the semi-circular portions of the notches, they will have pivoted jaws 88 and 89 completely closed (FIG. 4). Links 98 and 99 in turn will have pivoted bell crank members 94 and 95 such that locking pins 101 will have entered openings 103 and 105 to automatically lock each jaw in its closed position. Consequently, the hitch pins 40 are firmly held between fork plates 86 and 87 and jaws 88 and 89, and the inadvertent release of the implement is prevented by the locking pins 101.

Pins 25 and 27 are then removed, and cylinder 20 and arm 26 are unfolded. The piston rod of cylinder 20 is pinned to an intermediate portion of arm 26, and the end of chain 59 is connected to the outer end of arm 26, as shown in FIG. 6. After the various hydraulic lines have been properly connected, cylinders 73 and 74 will be operable to pivot moldboard 43 about pivot pin 61, and cylinder 20 will be operable to raise and lower the implement about the horizontal axis defined by the aligned hitch pins 40.

If blade 44 strikes a stationary obstacle, moldboard 43 is able to yield by pivoting about the axis of shafts 65. However, the moldboard is not able to pivot far enough to bang against the push frame or the pavement because chains 72 will reach their full extension before this occurs.

To uncouple the implement, chain 59 and the piston rod of cylinder 20 are disconnected from arm 26, and the cylinder 20 and arm 26 are folded up and secured in their storage positions (FIG. 1). Also, the various hydraulic lines are disconnected. Rings 104 are pulled to withdraw locking pins 101 from openings 103 and 105 to permit the operator to manipulate handles 92 and 93 appropriately to pivot jaws 88 and 89 to their open positions (FIG. 3). The truck may then be backed away from the implement which is thereafter supported in the FIG. 1 position.

It is pointed out that arms 35 angle outwardly and rearwardly from plate 34 toward the respective hitch pins 40. Therefore, if pins 40 are misaligned laterally in either direction as the snow plow is being coupled, one of the fork plates 86 or 87 will be engaged by the surface of one of the arms 35 and will ride along the arm surface until the plow is moved into proper lateral alignment with the hitch pin. In addition, the V-shaped notches in fork plates 86 and 87 provide a means for vertical self alignment during coupling of the snow plow. If hitch pins 40 are above or below center relative to the fork plates, the hitch pins will ride along the angled upper or lower edges of the V-shaped notches and shift the plates into alignment so that the pins will eventually be received in the semicircular base areas of the notches. Accordingly, proper coupling of the snow plow to the vehicle is readily achieved even with the hitch pins and fork plates misaligned up to 5 inches left or right and up to 2 inches up or down.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described my intention, I claim:

1. In snow plow apparatus for removable coupling with a vehicle, which apparatus includes a frame for mounting on the vehicle, the frame having a pair of laterally spaced hitch pins, a push frame having a plow on one end and a pair of fork-like members on the other end having notches for registry with said pins, the improvement comprising:

a pair of jaws, one for each notch, said jaws pivotally mounted to said fork-like members for movement between an open position permitting insertion of the pins in the notches and a closed position wherein the jaws and notches cooperate to retain the hitch pins in the notches, said jaws having camming surfaces operable in response to movement of the hitch pins toward and into the notches to pivot the jaws toward their closed positions, link means interconnecting each jaw with said push frame and operable to effect the movement of said jaws, said link means including a pair of hand levers, one for each jaw, connected with the link means and spaced away from said jaws to a position intermediate the plow and fork-like members, said hand levers operable to manipulate said link means to move said jaws between the open and closed positions, and automatic locking means connected with said link means for automatically locking each said link means against further movement in response to movement of its respective jaw to the closed position.

2. The improvement as set forth in claim 1, wherein said automatic locking means comprises:

a pair of locking pins supported on said link means at locations adjacent said hand levers, said locking pins moving with said link means in response to movement of said jaws;

means defining a pair of openings at locations to receive and retain the respective locking pins to thereby lock said jaws in place upon movement of the jaws to their closed position; and biasing means urging said locking pins to enter said openings in response to movement of said jaws to their closed position.

3. The improvement as in claim 1, wherein each said link means includes a bell crank means pivotally mounted to the push frame and a link member connected with the jaw and said bell crank means, said hand lever also being mounted on said bell crank means.

* * * * *